United States Patent [19]

Nakano et al.

[11] Patent Number: 4,655,182

[45] Date of Patent: Apr. 7, 1987

[54] METHOD AND SYSTEM FOR INTERNAL COMBUSTION ENGINE OXYGEN SENSOR HEATING CONTROL WHICH PROVIDE MAXIMUM SENSOR HEATING AFTER COLD ENGINE STARTING

[75] Inventors: Jiro Nakano; Takao Ishibashi; Takao Akatsuka; Mamoru Takata, all of Toyota, Japan

[73] Assignee: Toyota Jidosha Kabushiki Kaisha, Aichi, Japan

[21] Appl. No.: 666,388

[22] Filed: Oct. 30, 1984

[30] Foreign Application Priority Data

May 7, 1984 [JP] Japan ..... 59-090679

[51] Int. Cl.[4] ..... F02D 41/14

[52] U.S. Cl. ..... 123/440; 123/489

[58] Field of Search ..... 123/440, 489, 491; 204/406, 425, 412

[56] References Cited

U.S. PATENT DOCUMENTS

| | | | |
|---|---|---|---|
| 4,033,170 | 7/1977 | Kawamura et al. | 123/440 X |
| 4,170,967 | 10/1979 | Wessel et al. | 123/489 |
| 4,178,793 | 12/1979 | Bremer et al. | 123/440 X |
| 4,198,939 | 4/1980 | Masaki | 123/440 |
| 4,314,537 | 2/1982 | Asano et al. | 123/489 X |
| 4,332,225 | 6/1982 | Cox et al. | 123/440 |
| 4,356,065 | 10/1982 | Dietz | 204/1 T |

FOREIGN PATENT DOCUMENTS

| | | | |
|---|---|---|---|
| 69690 | 6/1977 | Japan . | |
| 130650 | 10/1981 | Japan | 204/406 |
| 200646 | 12/1982 | Japan | 123/489 |
| 200465 | 12/1982 | Japan | 123/489 |

*Primary Examiner*—Tony M. Argenbright
*Attorney, Agent, or Firm*—Kenyon & Kenyon

[57] ABSTRACT

An internal combustion engine has an exhaust system and an oxygen sensor fitted to the exhaust system including a sensor element and an electrically powered heater for heating the sensor element. A method for controlling the electrical power supplied to the heater properly and quickly heats up the sensor element after engine starting from the cold condition. At the time of starting up the engine it is determined whether or not the temperature of the engine is less than a certain value. If so, the heater is provided with electrical power to the maximum practicable amount, for a certain time interval after the engine is started up. Thereby, during engine heating up operation, the temperature of the sensor element is brought up to its minimum proper operating temperature as quickly as practicable, and accordingly it is ensured that engine performance and the quality of exhaust gas emissions at the time of such engine warming up operation are good. A system is also described for implementing this method.

8 Claims, 9 Drawing Figures

METHOD AND SYSTEM FOR INTERNAL COMBUSTION ENGINE OXYGEN SENSOR HEATING CONTROL WHICH PROVIDE MAXIMUM SENSOR HEATING AFTER COLD ENGINE STARTING

BACKGROUND OF THE INVENTION

The present invention relates to a method of controlling the heating of an oxygen sensor fitted to the exhaust system of an internal combustion engine for the purpose of controlling air—fuel mixture air/fuel ratio, and to a system for practicing the method. More particularly, the present invention relates to such a method and device for oxygen sensor heating control which provide maximum oxygen sensor heating for a certain time after starting up of the engine from a cold condition, so as to warm up the oxygen sensor to a temperature not less than its minimum active temperature as quickly as possible in order to perform air/fuel ratio control as soon as practicable.

It is known to fit an oxygen sensor to the exhaust system of an internal combustion engine. Such an oxygen sensor typically comprises a solid electrolyte or semiconductor, and varies a generated current or resistance in response to the concentration of oxygen in the exhaust gases of the engine. This electrical signal is fed to a control device which controls the amount of fuel provided to the engine in relation to the amount of air sucked thereinto, and is used for controlling the air/fuel ratio of the air—fuel mixture supplied to the engine by a feedback process. Various such forms of control device, which practice various methods of air—fuel mixture ratio control, are per se known.

The output of the sensor element of such an oxygen sensor varies with temperature, and, particularly when the air/fuel ratio is weak and is in the range of 14.5 to 25, in order for the sensor element to accurately measure the oxygen concentration, said sensor element must be maintained at a temperature higher than a certain critical minimum active temperature. This maintenance of the temperature of the sensor element can be done by using a heater, and oxygen sensors with sensor element heaters have already been proposed, along with methods for operation of such heaters; for example in Japanese Patent Application No. 53-78476, which has been published as Japanese Patent Publication No. 54-13396. Further, in Japanese Patent Application No. 53-83120, which has been published as Japanese Patent Publication No. 54-21393, there has been proposed a method and a system for control of the electrical power supplied to such an oxygen sensor element heater, in which the power is varied as a function of intake manifold pressure, of throttle opening, and of engine revolution speed, so as to ensure that the oxygen sensor element is kept at a temperature no lower than its minimum active temperature.

The sensor element of such an oxygen sensor fitted to an exhaust system is of course at a temperature substantially the same as that of the engine as a whole, when the engine has not been running for any substantial time. After the starting up of the engine it is very desirable for the sensor element to be warmed up at least to its said certain critical minimum active temperature as quickly as possible, in order to be able to properly perform control of the air/fuel ratio of the air—fuel mixture supplied to the engine by the abovementioned type of feedback process as quickly as possible after engine starting up, so as to provide good engine performance and fuel economy while maintaining good quality of the exhaust emissions of the engine; and this quick warming up of the sensor element is particularly required when the initial temperature of the engine and the sensor element is low, as during winter conditions or the like. In more detail, in the case of starting up of the engine from cold, when the coolant temperature of the engine is less than a certain critical value, then controlling the supply of electrical power to the heater according to the engine operational conditions as explained in the previous paragraph delays warming up of the sensor element and consequently delays the time point at which proper air/fuel ratio control of the intake mixture can be performed; while on the other hand, if on engine starting up the coolant temperature of the engine is greater than said certain critical value, then such normal control of the supply of electrical power to the sensor element heater does not cause such a problem.

In Japanese Patent Application No. 56-181006, which has been published as Japanese Patent Publication No. 58-83241, the suggestion has been made to supply a large current to the sensor element heater during engine warming up, so as to heat up the sensor element quickly. However, in this prior art, this sensor element heater power is suggested to be supplied in every instance of starting up, irrespective of whether the engine is cold or warm when it is being started up, and accordingly sometimes such sensor element heater power may be supplied when not necessary. This is in some circumstances wasteful of energy, and may lead to overheating of the sensor element, as well as placing undue strain on the heater element.

SUMMARY OF THE INVENTION

Accordingly, it is the primary object of the present invention to provide a method and system for internal combustion engine oxygen sensor heating control, which provide a high power level to the sensor element heater so as quickly to bring the sensor element to its minimum active temperature, from when the engine is started.

It is a furthr object of the present invention to provide such a method and system for oxygen sensor heating control, which only provide such a high warming up power level for the sensor element heater, when it is necessary to do so.

It is a further object of the present invention to provide such a method and system for oxygen sensor heating control, which heat the oxygen sensor according to the values of easily measured engine parameters, and which can further properly warm up the oxygen sensor from the cold engine starting condition.

It is a further object of the present invention to provide such a method and system for oxygen sensor heating control, which do not use electrical power unnecessarily.

It is a further object of the present invention to provide such a method and system for oxygen sensor heating control, which do not risk overheating the heater element of the oxygen sensor heater.

It is a further object of the present invention to provide such a method and system for oxygen sensor heating control, which do not place unnecessary stress on the heater element of the oxygen sensor heater.

It is a yet further object of the present invention to prvide such a method and system for oxygen sensor heating control, which provides good initial performance of the engine during its warming up operational phase.

It is a yet further object of the present invention to provide such a method and system for oxygen sensor heating control, which maintains good engine fuel economy during initial engine driving operation while warming up.

It is a yet further object of the present invention to provide such a method and system for oxygen sensor heating control, which do not allow that during initial engine warming up operation the quality of the exhaust emissions of the engine should be poor.

According to the most general method aspect of the present invention, these and other objects are accomplished by, for an internal combustion engine comprising an exhaust system and an oxygen sensor fitted to said exhaust system comprising a sensor element and an electrically powered heater for heating said sensor element: a method for controlling the electrical power supplied to said heater, wherein: when at the time of starting up the engine the temperature of said engine is less than a certain value, said heater is provided with electrical power to the maximum practicable amount, for a certain time interval after said engine is started up. According to the most general device aspect of the present invention, these and other objects are accomplished by, for an internal combustion engine comprising an exhaust system and an oxygen sensor fitted to said exhaust system comprising a sensor element and an electrically powered heater for heating said sensor element: a system for controlling the electrical power supplied to said heater, comprising: a means for detecting the temperature of said engine at the time of starting up; a means for determining whether or not said starting up engine temperature is less than a predetermined value or not; and a means for, if at said time of starting up the engine the temperature of said engine is less than said certain value, providing said heater with electrical power to the maximum practicable amount, for a certain time interval after said engine is started up.

According to such a method and such a system, if it is decided that the starting up of the engine is in fact a starting up from the cold condition, then a high value of electrical power supply is provided to the heater, so as to speed up the warming up of the oxygen sensor without causing overheating problems, and so as to get the oxygen sensor to its active temperature as soon as practicable. Since the warming up characteristics of the oxygen sensor after a cold start depend only on the supply of heat from the heater and not on the temperature of the engine, such a time control of the maximum practicable heater current as suggested above is appropriate. Thereby, engine performance and the quality of exhaust gas emissions at the time of such engine warming up from the cold condition are kept good. In alternative possibilities, the starting time as described above may in fact mean the time point at which the starter switch of the vehicle is turned on, or alternatively the time at which said starter switch is turned off.

Since the colder is the engine at the time of cold starting the colder is the oxygen sensor, as a particular specialization of the present invention, the period of time for which the maximum current is applied to the oxygen sensor heater may be the longer, the colder is the initial state of the engine. Further, since the effectiveness of operation of the heater is less, the lower is the voltage of the electrical source for operating said heater, the period of time for which the maximum current is applied to the oxygen sensor heater may be the longer, the lower is this voltage of the electrical source. Further, in order not to damage the heater, and in order to avoid problems from overheating, e.g. from switching on surging, said maximum practical amount of heater power may be required to be restricted; however, if there is no danger from this angle, it is desirable that said maximum practical amount of heater power should be the maximum power deliverable from the power source to said heater.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENTS

Figure 1:
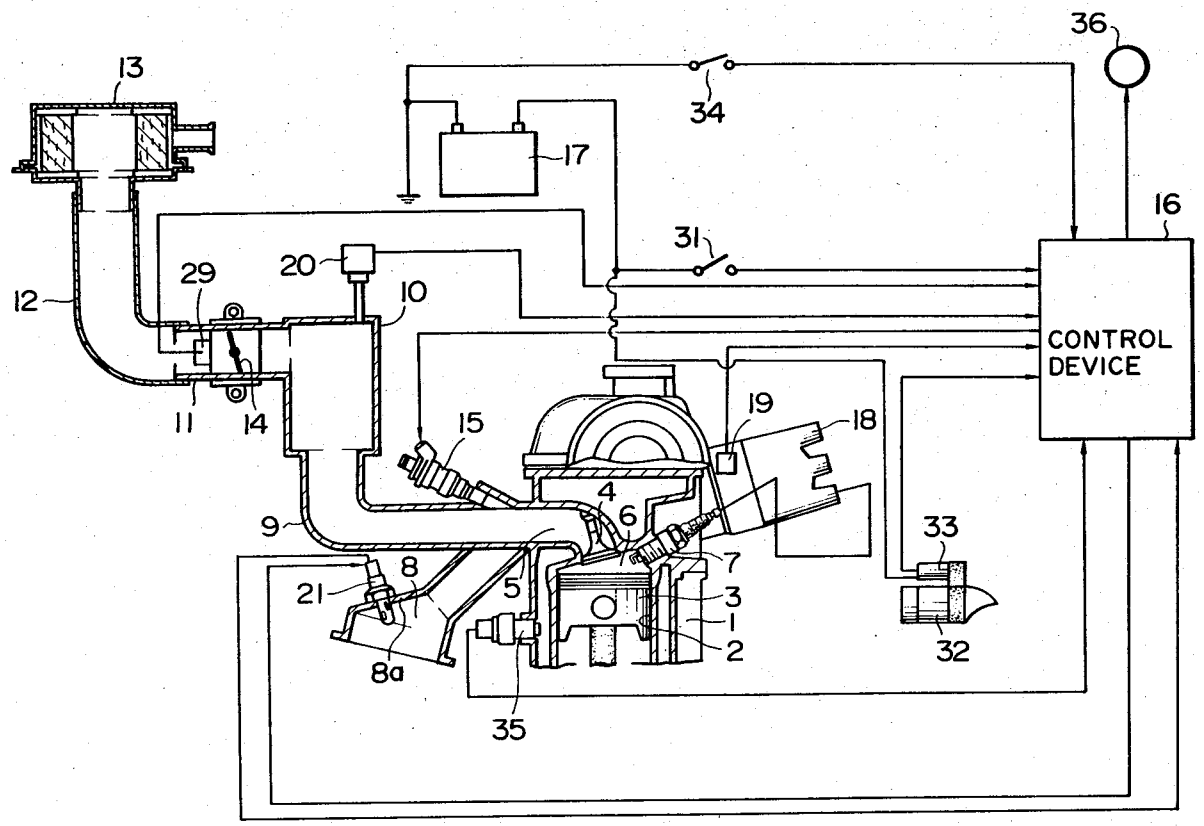
FIG. 1 is a partly schematic partly sectional view of an internal combustion engine which is equipped with the first preferred embodiment of the oxygen sensor heating control system of the present invention, also showing various ancillary elements thereof.

FIG. 1 shows in schematic view an internal combustion engine with an oxygen sensor of the above described kind, said engine incorporating the first preferred embodiment of the oxygen sensor heating control system of the present invention, for performing the first preferred embodiment of the oxygen sensor heating control method of the present invention. In this figure, the internal combustion engine 1 has a cylinder bore 2 within which a piston 3 reciprocates, said piston 3 being coupled in a per se conventional manner to a crankshaft, not shown, by a connecting rod, only partially shown; in fact the engine 1 has a plurality of such cylinders and pistons but only one of each of them can be seen in the figure. A combustion chamber 6 is defined above the piston 3 in the figure in the cylinder bore 2, between it and a cylinder head, and an intake port 5 opens to this combustion chamber 6 via a valve aperture the opening and closing of which is controlled by an intake valve 4. A per se conventional spark plug 7 provides ignition for air—fuel mixture in the combustion chamber 6 when appropriately energized. Further, an exhaust port, not shown in the figure, opens to the combustion chamber 6 via a valve aperture the opening and closing of which is controlled by an exhaust valve, also not shown, and to this exhaust port there is connected an exhaust system, only a portion of an exhaust manifold 8 incorporated in which is shown.

To the inlet port 5 there is connected the downstream end of an intake manifold 9, the upstream end of which is connected to the outlet of a surge tank 10. To the inlet of the surge tank 10 there is connected the downstream end of a throttle body 11, the upstream end of which is connected to the downstream end of an inlet tube 12. The upstream end of this inlet tube 12 is communicated to the outlet of an air cleaner 13, the inlet of which is left open to the atmosphere. In the throttle body 11 there is mounted an intake butterfly valve 14 the opening and closing action of which for intake air amount control is linked to the foot depression movement of a throttle pedal for the engine 1, not shown, by a throttle pedal linkage also not shown.

To the intake manifold 9 there is mounted a per se conventional fuel injection valve 15 which incorporates a solenoid 15*a* (not shown in FIG. 1), and this fuel injection valve 15 is supplied with pressurized fuel (i.e. gasoline) by a fuel supply system which is not shown. The opening and closing action of this valve 15 is electronically controlled by a control device 16 which will be more particularly described hereinafter, Thus, the valve 15 squirts spirts of fuel into the intake manifold 9 the total volume of each of which depends on the opening and closing times thus provided for said fuel injection valve 15 by the control device 16.

The control device 16 is supplied with actuating electrical energy from the battery 17 of the vehicle to which this engine 1 is fitted, via an ignition switch 31. To the distributor 18 of the engine 1 there is fitted a crank angle sensor 19, the electrical output signal of which is representative of the position of the crankshaft of the engine 1 and is dispatched to the control device 16. To the surge tank 10 of the engine 1 there is fitted an intake pressure sensor 20, the electrical output signal of which is representative of the air pressure in the intake system of the engine 1 and is also dispatched to the control device 16. To the wall 8a of the exhaust manifold 8 of the engine 1 there is fitted an oxygen sensor 21 to be more particularly described later, the electrical output signal of which is representative of the oxygen concentration in the exhaust gases flowing through said exhaust manifold 8 and is also dispatched to the control device 16; and the oxygen sensor 21 further has a heater 28 as will be described later, supply of actuating electrical energy to which is provided from the control device 16. To the throttle valve 14 mounted in the intake system of the engine 1 there is fitted a throttle valve idling opening amount sensor 29 incorporating a switch 29*a* (not shown particularly in FIG. 1), the electrical output signal of which is also dispatched to the control device 16 and is representative of the opening amount of said throttle valve 14, being ON when said throttle valve 14 is opened by more than a predetermined amount and thus indicating engine operation at a level higher than idling level and being OFF when the throttle valve 14 is opened by less than said predetermined amount and thus indicating engine idling operation. To the starter 32 of the engine 1 there is fitted a starter switch 33, an electrical output signal from which is indicative of whether said starter 32 is being actuated to crank said engine 1 or not and is also dispatched to the control device 16. And to the water jacket of the engine 1 there is fitted a water temperature sensor 35, the electric output signal of which is indicative of the temperature of the cooling water of said engine 1 and is also dispatched to the control device 16. Further, a test switch 34 optionally provides earthing for a terminal of the control device 16, and an output signal from said control device 16 is fed to a test alarm lamp 36.

Figure 2:
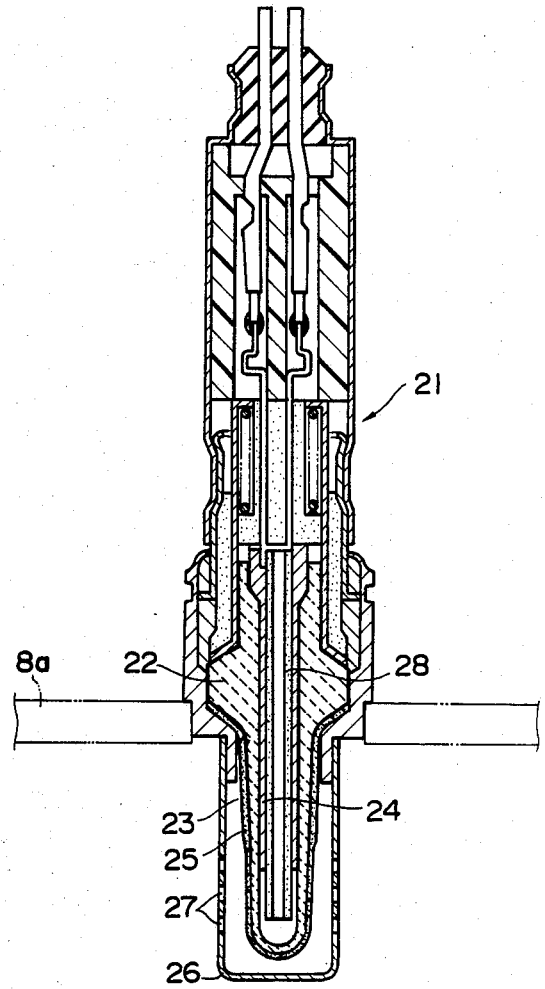
FIG. 2 is a longitudinal sectional view of an oxygen sensor fitted to the engine of FIG. 1 and shown in said figure.

Referring to FIG. 2, the oxygen sensor 21 fitted in the wall 8a of the exhaust manifold 8, in this shown preferred embodiment, comprises a sensor element 22 formed as a tube with one end closed and made of a solid electrolyte material such as zirconia which can transmit oxygen ions. The outside of this sensor element 22 has, laid on it, an outer electrode 23 formed as a porous thin conducting layer (this layer is not clearly separately shown in the figure because it is so thin as to be represented by a single line), and the inside of said sensor element 22 has, likewise laid on it, an inner electrode 24 likewise formed as a porous thin conducting layer (again, this layer is shown only by a single line in FIG. 2). The outer surface of the outer electrode 23 has an exhaust gas dispersion layer 25 also laid on it, said layer 25 being formed of porous ceramic. The sensor element 22, etc., are mounted within a casing and so on, not particularly described here because they are per se known, and are fixed into the wall 8a of the exhaust manifold 8 with their lower parts in FIG. 2 projecting into the interior of said exhaust manifold 8. And a shield 26 with a plurality of holes 27 formed therein is provided around said lower ends of the sensor element 22 etc. projecting into the exhaust manifold 8, so as to protect them from the impact of the rushing flow of exhaust gases in the exhaust manifold 8, while allowing said exhaust gases to impinge gently on the exhaust gas dispersion layer 25 and the outer electrode 23 to reach the sensor element 22. During use of this oxygen sensor 21 as a current limiting type lean sensor, a certain voltage is applied by the control device 16 between the outer electrode 23 and the inner electrode 24, so that the current between these electrodes increases approximately in proportion to the oxygen concentration in the exhaust gases flowing through the exhaust manifold 8, within certain limits, as is per se well known. And in order to keep the sensor element 22 etc. at the correct temperature for activation, an electrical heater 28 is provided for the oxygen sensor 21. This heater 28 is a per se known type of resistive heater, and the magnitude of the heating power instantaneouly provided thereby is proportional to the product of the voltage and the amperage being provided by the control device 16 thereto.

The shown oxygen sensor can detect the air/fuel ratio of the exhaust gases, i.e. the oxygen concentration, in a substantially linear manner, and is of the so called current limit type. However, the present invention is also applicable to the control of the heating of an oxygen sensor of the so called oxygen concentration battery cell type, the electromotive force produced by which significantly changes as the air/fuel ratio changes across the stoichiometric value, although no particular example thereof will be shown. This battery cell type of sensor does not include an exhaust gas dispersion layer such as the layer 25 of the shown oxygen sensor, and does not require any voltage to be applied to it.

The function of the control device 16 is in partial outline as follows. From the data it receives relating to engine rotational speed from the crank angle sensor 19 and relating to intake manifold pressure from the intake manifold pressure sensor 20, it determines the volume of intake air which is being sucked into the combustion chamber in each intake stroke of the piston 3, and according thereto it determines a theoretically proper amount of fuel to be mixed with this intake air to provide a proper and appropriate target value for the air/fuel ratio of the air—fuel mixture in the combustion chamber. And, during normal engine operation when the engine 1 has been warmed up as is indicated by the output of the engine cooling water temperature sensor 35, based upon the actual value of the oxygen concentration in the exhaust gases in exhaust manifold 8 of the engine 1 as detected by the oxygen sensor 21, information regarding which is dispatched therefrom to the control device 16, said control device 16 makes a correction to this theoretical value in order to produce a value for the actual amount of fuel to be injected, so as to bring the air/fuel ratio to its target value by a form of per se known feedback control. Then, the control device 16 produces electrical output signals at appropriate crank angles and supplies them to the solenoid **15*a* of the fuel injector 15, so as to control the opening and closing of the fuel injector 15** so as to inject this determined appropriate amount of fuel, in each injection spirt.

Figure 3:
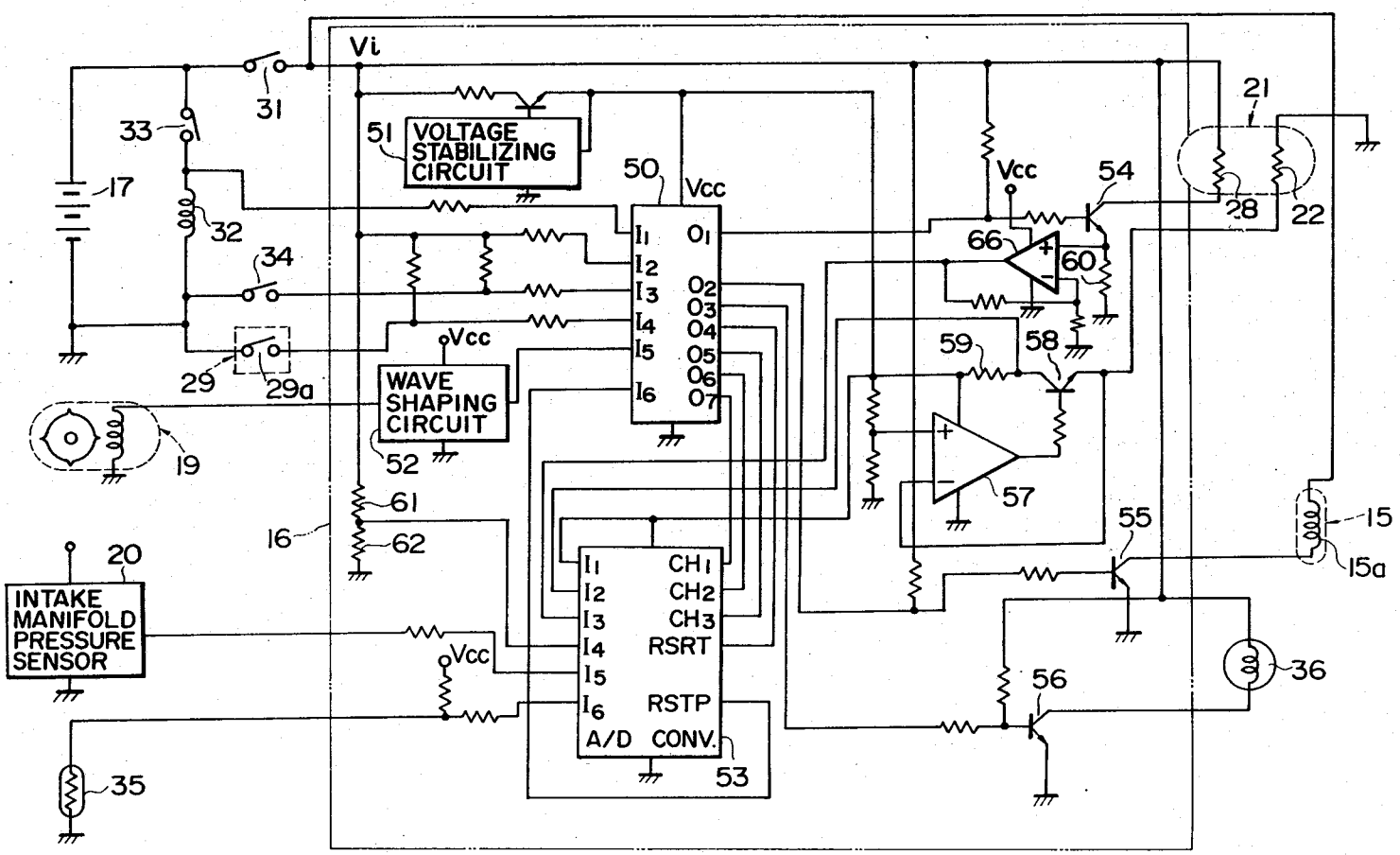
FIG. 3 is a partial circuit diagram of the first preferred embodiment of the oxygen sensor heating control system of the present invention, and of various ancillary elements thereof, and particularly shows a microcomputer incorporated in said control system.

Referring to FIG. 3, herein the internal structure of the control device 16 is partially shown as an electrical circuit diagram, and also ancillary circuits relating thereto are shown. This control device 16 comprises a microcomputer 50, which may be for example of the Motorola 6801 type, and this microcomputer 50 is powered, like other parts of the circuitry of the control device 16, by a constant voltage Vcc supplied by a voltage regulator circuit 51 of a per se well known type, when and only when the ignition switch 31 of the vehicle is ON. This microcomputer 50 of this first preferred embodiment has six inputs designated in the figure as I1 through I6 and seven outputs designated os O1 through O7. The inputs I1 through I6 are connected as follows. The input I1 receives an ON signal when and only when the starter switch 33 is in the ON state. The input I2 receives an ON signal when and only when the ignition switch 31 of the vehicle is in the ON state. The input I3 receives an ON signal when and only when the test switch 34 is in the OFF state. The input I4 receives an ON signal when and only when the switch **29*a* incorporated in the throttle valve idling opening amount sensor 29 is in the OFF state, i.e. when and only when the engine 1 is not idling. The input I5 receives the output of the crank angle sensor 19, after this has been converted to a square wave by a shaping circuit 52. And the input I6 receives a pulse width signal from a RSTP terminal of an A/D converter (an analog-digital converter) 53 of a per se well known sort. Further, the outputs O1 through O7 are connected as follows. The signal from the output O1 is furnished to the base of a transistor 54 as a pulse signal, so as to control the power supplied to the heater 28 of the oxygen sensor 21 as will be explained hereinafter. The signal from the output O2 is furnished to the base of a transistor 55 as a pulse signal, so as to control the solenoid 15*a* of the fuel injector 15 for providing fuel injection. The signal from the output O3 is furnished to the base of a transistor 56 as a sensor diagnostic result signal, so as to selectively energize the test alarm lamp 36 according to the result of circuit testing, as will be explained hereinafter. The signal from the output O4 is furnished to a convert control terminal RSRT of the A/D converter 53 as a convert start signal. And the signals from the outputs O5 through O7 are furnished as channel control signals to the channel control terminals CH1 through CH3 respectively of said A/D converter 53**.

The transistor 54 receives the pulse signal from the output O1 of the microcomputer 50 at its base and is thereby selectively switched ON so as to provide power via its collector to the heater 28 of the oxygen sensor 21 when and only when said pulse signal from said output O1 is ON. This power for the heater 28 is provided directly from the battery 17 via the ignition switch 31, i.e. not via the voltage regulation circuit 51. The transistor 55 receives the pulse signal from the output O2 of the microcomputer 50 at its base and is thereby selectively switched ON so as to provide power via its collector to the solenoid coil **15*a* of the fuel injector 15 when and only when said pulse signal from said output O2 is ON. And the transistor 56 receives the signal from the output O3 of the microcomputer 50 at its base and is thereby selectively switched ON so as to provide power via its collector to the test alarm lamp 36, when and only when said signal from said output O3 is ON. And the reference numeral 57 denotes a differential amplifier: when the ignition switch 31 is ON, then a constant voltage Vcc is provided via the voltage regulation circuit 51, and drives the transistor 58 to supply a constant voltage to the sensor element 22 of the oxygen sensor 21**.

The A/D converter 53 comprises a multiplexer, not particularly shown, and is powered by the constant voltage Vcc supplied by the voltage regulator circuit 51. This A/D converter 53 of this first preferred embodiment has six inputs designated as I1 through I6, as well as a control terminal RSRT and an output terminal RSTP and channels CH1 through CH3. The inputs I1 through I6 are connected as follows. The input I1 receives the reference voltage signal Vcc. The input I2 receives a voltage signal dropped from this reference voltage Vcc by a variable amount which depends upon the current through the sensor element 22 of the oxygen sensor 21 because of the resistor 59 as shown in the circuit diagram of FIG. 3. The input I3 receives a voltage signal amplified by a differential amplifier 66 from the voltage across a load dropping resistor 60, thus detecting the value of the current passing through the heater 28 of the oxygen sensor 21. The input I4 receives a voltage signal proportional to the current value of the voltage Vi being supplied by the battery 17, according to the operation of a voltage divider circuit incorporating two resistors 61 and 62. The input I5 receives a voltage signal representative of the pressure in the surge tank 10 of the engine intake system from the intake pressure sensor 20. And the input I6 receives a voltage signal representative of the temperature of the cooling water of the engine 1 from the engine cooling water temperature sensor 35.

Thus during operation by using a combination of the CH1 through CH3 signals from the microcomputer 50 a particular one of the input signals I1 through I6 is selected, and then, when the "start A/D convert" signal is dispatched by the microcomputer 50 (from its output O4) and is received at the RSRT terminal of the A/D converter 53, said A/D converter 53 performs the analog - digital conversion process and outputs a pulse width signal corresponding to the voltage of the selected input from its output terminal RSTP to the input I6 of the microcomputer 50. In particular, the microcomputer 50 receives pulse width signals from the A/D converter 53 which are together representative of the voltage across the current detecting resistor 59 for the sensor element 22 of the oxygen sensor 21, said signals being received by said A/D converter 53 at its I1 and I2 input terminals. By converting these pulse width signals into digital values and by subtracting one of them from the other, the microcomputer 50 can obtain a digital value representative of said voltage across said sensor element 22. This value, which is representative of the oxygen concentration in the exhaust gases flowing through the exhaust manifold 8, is the value that the microcomputer 50 uses for performing the above described feedback control of the air/fuel ratio of the air—fuel mixture supplied to the engine 1, when appropriate.

Now, the operation of this first preferred embodiment of the oxygen sensor heating control system of the present invention, while performing the first preferred embodiment of the oxygen sensor heating control method of the present invention will be explained with reference to FIG. 4, which is a flow chart of the operation of a part of the program stored in the microcomputer 50. This flow chart shows the operation of a subroutine for controlling supply of electrical energy to the heater 28 of the oxygen sensor 21; and this subroutine is caused to be executed by the microcomputer 50 when the ignition switch 31 is turned on.

First, in the step 1, in an initialization step, a flag F is set to zero and a count C is also set to zero.

Next, in the step 2, a test is made as to whether the starting switch 33 is in the ON position or not. If it is, then the the engine is considered as being in the process of being warmed up, and the flow of control passes next to the step 3; but if it is not then control passes next to the step 5.

In the step 3, the flag F is set to zero and the count C is also set to zero, and then control passes to the step 4, in which the duty ratio D of the voltage to be supplied to the heater element 28 of the oxygen sensor 21 is set to zero, indicating that no power is to be supplied to said heater element. Next, the flow of control passes to the step 17 for actual setting of this heater element voltage.

On the other hand, if control has passed to the step 5, next a test is made as to whether the engine revolution speed Ne is greater than a certain predetermined engine revolution speed Neset indicative of idling revolution speed, for example 500 rpm, or not. If the answer is NO, which is taken as indicating that the engine is only operating in idling condition, then the flow of control again passes next to the step 3; but if the answer is YES, indicating that the engine is operating at a level higher than idling operational condition, then control passes next to the step 6.

Next, in the step 6, the value of the battery voltage Vi is determined by, as described above, selecting the input I4 of the A/D converter 53 (see FIG. 3), which receives a voltage representative of this battery voltage Vi. In this case, the A/D converter 53 sends an output pulse signal representative of the battery voltage Vi to the microcomputer 50. Also, similarly, the value of the output signal of the sensor 35, representing the temperature Tw of the engine cooling water, is determined by selecting the input I6 of the A/D converter 53.

Next, in the step 7, a test is made as to whether the current value Tw of the cooling water temperature is less than a certain threshold value Twset, or not. For example, this threshold value Twset may be about 65° C. If it is not, then the the engine is considered as now being fully warmed up, and the flow of control passes next to the step 12; but if it is, then the engine is considered as being still in the process of being warmed up, and control passes next to the step 8.

Next, in the step 8, a test is made as to whether the flag F is equal to zero, or not. If it is not, then the flow of control passes next to the step 10; but if it is, control passes next to the step 9.

Figure 5:
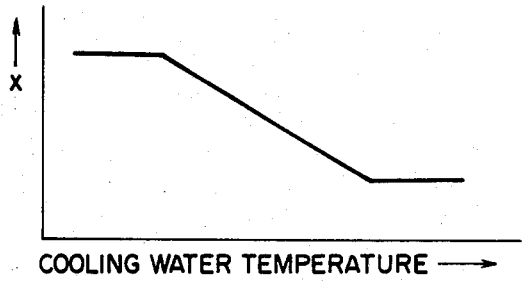
FIG. 5 is a graph showing the value of a quantity X representing a typical engine warming up time along the vertical axis and the value of engine cooling water temperature along the horizontal axis.

In this step 9, the value of a count limit Cset is set to be equal to the value Vb/Vi multiplied by a basic value X, and the flag F is set to 1, in order to prevent this count limit Cset being reset again until required. Vb is the rated voltage of the battery 17, while Vi is the actual measured voltage, which will be less than said rated voltage Vb according to loss in the wiring harness and so on. And the value X is one that corresponds to a basic heater full power operation time of for example 200 to 400 seconds. Alternatively, as suggested in FIG. 5 which is a graph showing the value of the quantity X along the vertical axis and the value of engine cooling water temperature along the horizontal axis, the value of X may be varied according to the engine cooling water temperature Tw, so that X is larger the lower the engine cooling water temperature Tw is. Next, the flow of control passes to the step 10.

In this step 10, the duty ratio D of the voltage to be supplied to the heater element 28 of the oxygen sensor 21 is set to unity; in other words the power to be supplied to said heater element 28 is set to be maximum. Next, control passes to the step 11.

Next, in the step 11, a test is made as to whether the value of the time counter C is greater than or equal to the count limit Cset, or not. It should be understood that this time counter C is upcounted at fixed time intervals from the time when in the step 17 of this program a pulse signal with duty factor 1 is output to the base of the transistor 54 for setting the voltage across the sensor element heater 28. If this time count value C is not greater than the count limit Cset, then the flow of control passes next to the step 17; but if it is, indicating that the engine warming up process is completed, then control passes next to the step 12.

In this step 12, the flag F is set to zero and the count C is also set to zero.

Next, in the step 13, the value of the current Ih through the heater 28 is determined by selecting the input I3 of the A/D converter 53 which receives a voltage representative of that across the heater current detecting resistor 60. In this case, the A/D converter 53 sends an output pulse signal representative of the heater current Ih to the microcomputer 50.

Next, in the step 14, first the current values of the intake manifold pressure Pm and the engine revolution speed Ne are determined by the microcomputer 50: the intake manifold pressure Pm is determined in a similar way to the determination of the heater current Ih in the step 13 by the microcomputer 50 selecting the input I5 of the A/D converter 53, and the engine revolution speed Ne is determined by calculating the time interval between successive pulses from the crank angle position sensor 19 supplied to the input terminal I5 of the microcomputer 50. Next, by consultation of a two way look up table of values stored in the ROM (read only memory) of the microcomputer 50, a proper and appropriate value for the amount Wh of electrical power to be supplied to the heater 28 of the oxygen sensor 21 is determined. The values of Wh in this look up table in the ROM are determined in advance by experiment, and generally decrease as the intake pressure increases and as the engine revolution speed increases.

Next, in the step 15, the average value Vh of the voltage to be supplied to the heater 28 is calculated as the ratio of the desired power Wh and the actual present current Ih. Although this is not actually precisely theoretically correct, since change in the voltage value will alter the current in turn, nevertheless, because the program the flow chart of which is shown in FIG. 4 is repeated a large number of times per second, the actual proper value of this average voltage Vh to provide the desired power Wh will be attained by a homing-in process, as will be easily understood based upon the descriptions herein.

Next, in the step 16, the duty ratio D of the voltage signal to be supplied to the heater 28, in order to obtain the correct desired power supply value Wh, is calculated as the ratio of the desired average voltage Vh and the actual voltage Vi which is being provided by the battery 17. This battery voltage Vi is determined by the microcomputer 50 in a similar way to the determination of the heater current Ih in the step 4 by the microcomputer 50 selecting the input I4 of the A/D converter 53.

Next, in the step 17, to which the various flows of control converge as shown by the flow arrows, the final obtained value of the variable D, through whichever path the flow of control may have come to reach this step 17, is used as a duty factor to control the voltage applied to the heater 28, by driving the base of the transistor 54 from the output O1 of the microcomputer 50. By powering the heater 28 at a voltage using this duty factor D, the mean voltage on said heater 28 is caused to be the required value Vh, and thus the power dissipated by the heater 28 is brought to be the desired power dissipation Wh, by a homing-in process as explained above. After this is done, the flow of control returns to the step 2, to repeat the shown cycle again.

Figure 4:
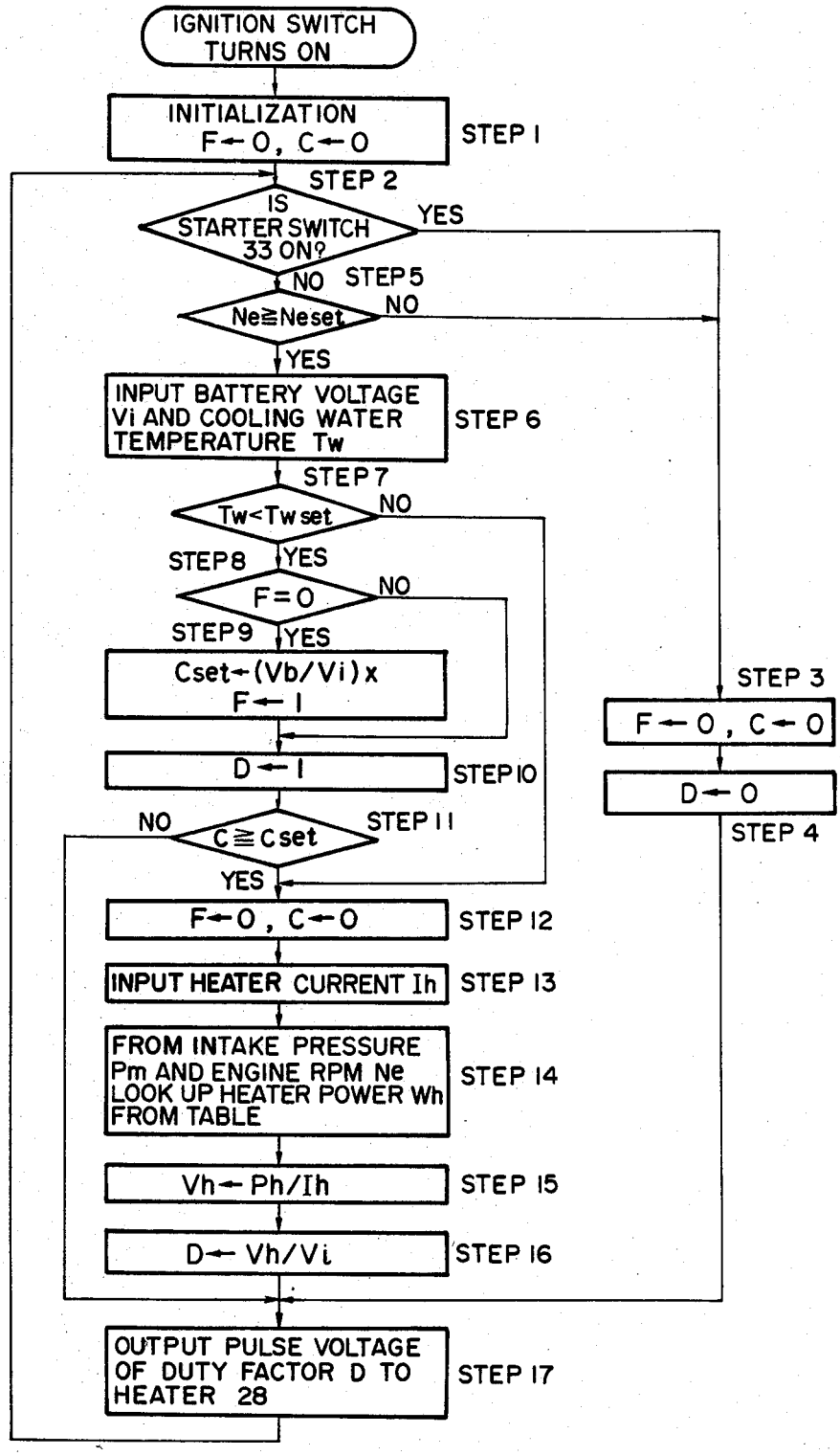
FIG. 4 is a flow chart of a program stored in the memory of said microcomputer of FIG. 3 and executed by it during the practice of the first preferred embodiment of the oxygen sensor heating control method of the present invention.
Figure 7:
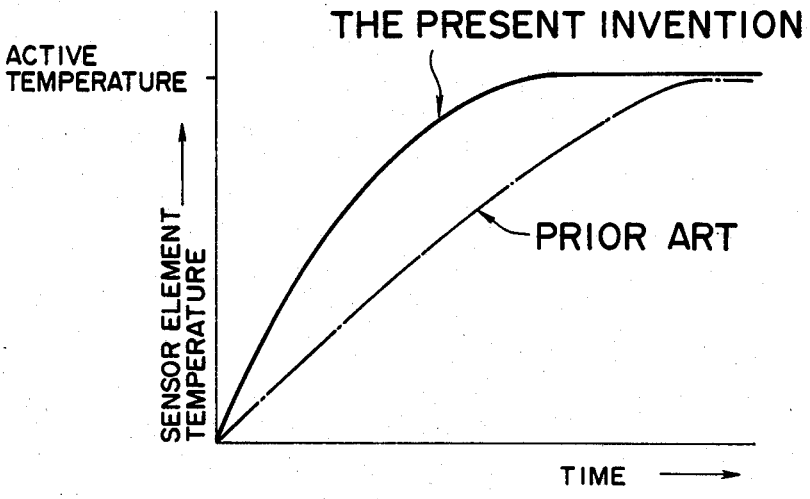
FIG. 7 is a graph showing temperature of the sensor element on the vertical axis and the time on the horizontal axis, both with regard to the present invention as shown by the solid line and with regard to a typical prior art as shown by the single dotted line.
Figure 6:
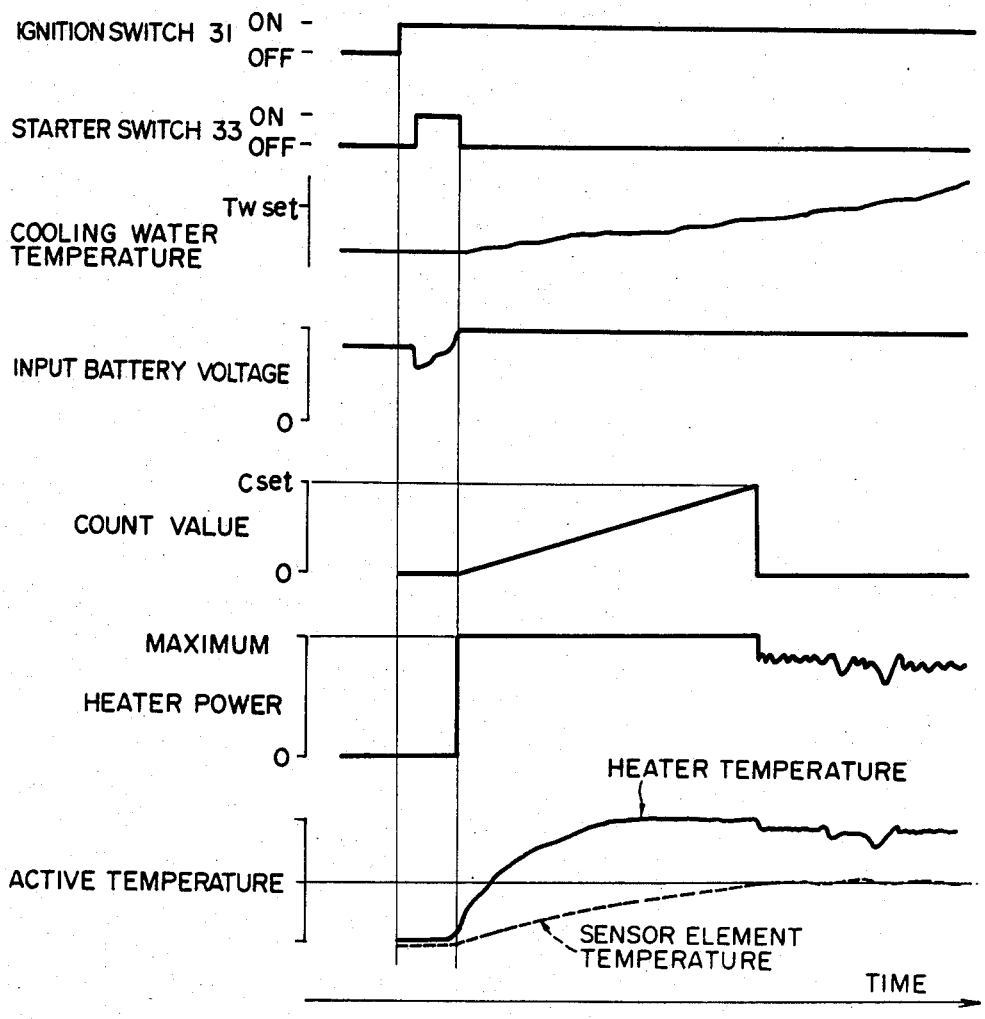
FIG. 6 is a time chart showing, against time, the variation of the ON/OFF situation of an ignition switch and a starter switch, the temperature of the cooling water of the engine, the voltage being delivered by the battery of the vehicle incorporating this system, the value of a count C in the program of FIG. 4, the power being supplied to the heater for the oxygen sensor element, and the temperature of said heater and the temperature of said oxygen sensor element, in the case of this first preferred embodiment of the present invention.

Thus, referring to FIG. 6, which is a time chart showing, against time, the ON/OFF situation of the ignition switch 31 and the starter switch 33, the temperature of the cooling water of the engine 1, the voltage being delivered by the battery 17, the value of the count C in the program of FIG. 4, the power being supplied to the heater 28, and the temperature of said heater 28 and the temperature of the sensor element 22 of the oxygen sensor 21, it will be seen that when starting the engine, if the initial cooling water temperature Tw is less than the critical value Twset, then for a certain time determined by the value x and limited by Cset, the maximum power of the battery (i.e. a voltage with duty ratio unity) is delivered to the heater 28 to heat up the sensor element 22 as quickly as possible. The required period is determined experimentally; in FIG. 7, which is a graph showing sensor element temperature on the vertical axis and time on the horizontal axis for the present invention by the solid line and for a typical prior art by the single dotted line, it is demonstrated that the sensor element 22 is heated up to its minimum active temperature more quickly by the method and system of the present invention, than by a prior art method and system.

Accordingly it is seen that, by increasing the duty factor of the voltage to unity, and therefore by increasing the power to maximum, supplied to the heater 28 when the internal combustion engine 1 is being warmed up from a cold start, the temperature of the sensor element 22 is brought as quickly as possible to be at least its minimum proper operating temperature. Thus, as soon as possible after starting up the engine 1, the sensor element 22 is hot enough to be able to operate properly and to dispatch a signal properly indicative of oxygen concentration in the exhaust gases of the engine 1, and accordingly air/fuel ratio control for the air—fuel mixture being supplied to the engine 1 may be properly performed at this time, thus ensuring that this air/fuel ratio does not improperly become raised and that the air—fuel mixture does not become too weak to be ignited. Thereby, engine performance and the quality of exhaust gas emissions soon after engine starting are made to be good.

However, after the aforesaid certain time determined by the value x and limited by Cset has elapsed after engine starting, or if at engine starting the initial cooling water temperature Tw is greater than the critical value Twset, then according to such a method and such a system according to the first preferred embodiment of the present invention as described above, since the supply of electrical power to the heater 28 is determined during such warmed up operation of the engine according to the same parameters as the fuel injection amount, i.e. according to engine intake manifold pressure (engine load) and engine revolution speed, the control of this heater 28 to keep the oxygen sensor element 22 at its proper operating tmperature is simple and is cheaply and effectively performed, and thus accurate oxygen concentration detection and accurate air—fuel mixture air/fuel ratio control, are provided.

Figure 8:
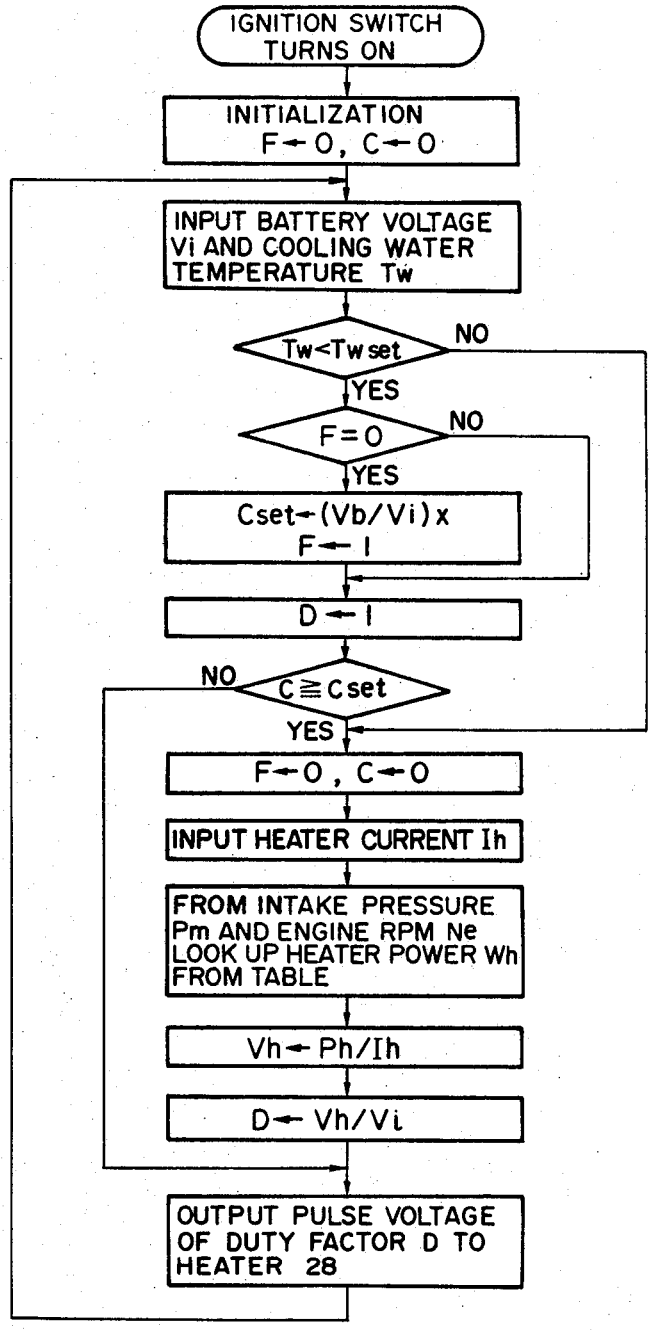
FIG. 8 is, similarly to FIG. 4 for the first preferred embodiment, a flow chart of a program stored in the memory of said microcomputer of FIG. 3 and executed by it during the practice of the second preferred embodiment of the oxygen sensor heating control method of the present invention.
Figure 9:
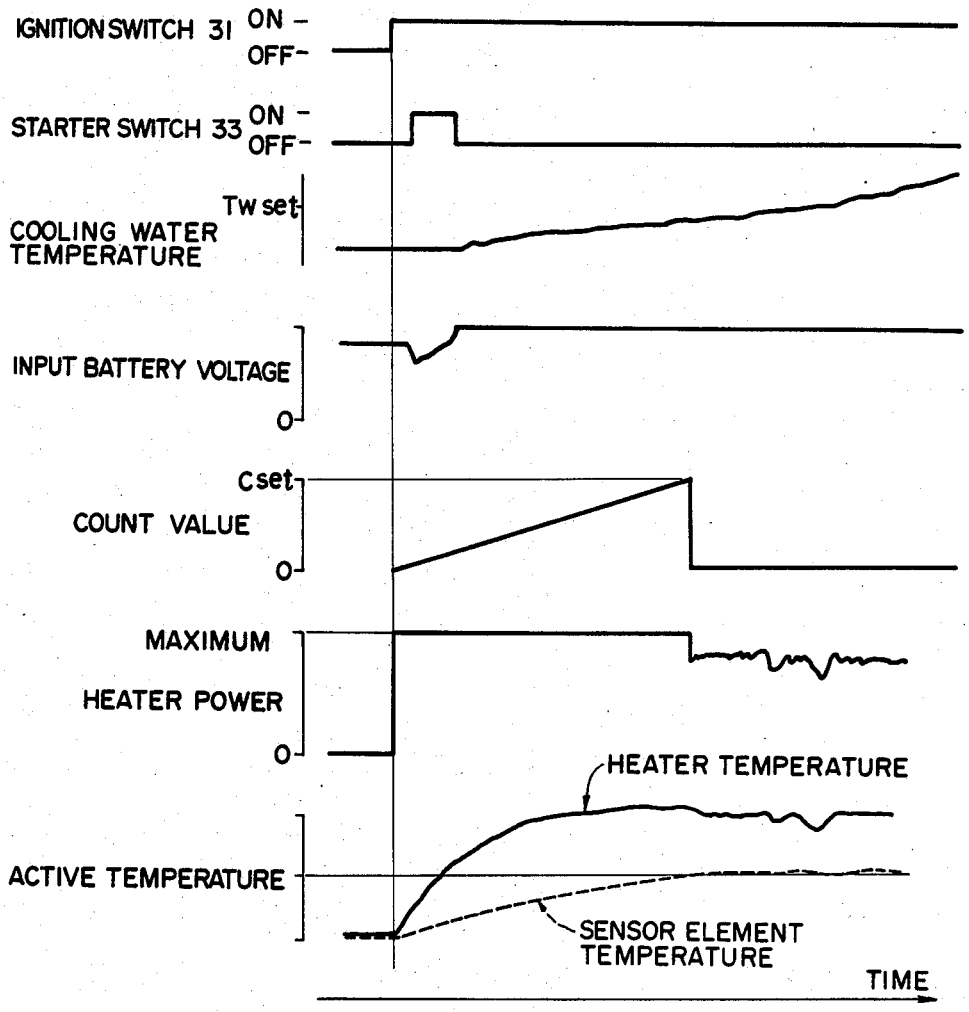
FIG. 9 is, similarly to FIG. 6, a time chart showing the variation of the same variables with respect to time, in the case of said second preferred embodiment of the present invention.

In the above described first preferred embodiment of the present invention, the supply of power to the heater 28 was commenced after the starter switch 33 was turned off, but if no substantial problems of battery drain are likely to be caused, then it is possible to start such a maximum power supply to the heater 28 as soon as the starter switch 33 is turned on, in order to get the sensor element 22 to its operating temperature as soon as possible. This is done in the second preferred embodiment of the present invention: FIG. 8 shows the flow chart of the program of the microcomputer 50 in this second preferred embodiment. It will be seen that this flow chart differs from the flow chart of FIG. 4, only in the omission of the steps 2, 3, 4, and 5, which handle the test for starting. The corresponding time chart to the chart of FIG. 6 for the second embodiment is shown in FIG. 9, and it will be seen from this figure that the heating up of the sensor element 22 is commenced as soon as the ignition switch 31 is switched on, in this second preferred embodiment. Accordingly, the same advantages and benefits are obtained, as in the case of the first preferred embodiment, described above.

Although the present invention has been shown and described with reference to the preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. For example, although in the shown preferred embodiments the parameters according to which the fuel injection amount for the engine, and the amount of heater power provided for the oxygen sensor element heater, were engine intake manifold pressure and engine revolution speed, the present invention is not limited to this choice of parameters, and for example engine intake air flow and engine revolution speed could be utilized instead; other variations, such as throttle opening, are also possible for the chosen parameters. And also, as mentioned above, the oxygen sensor could be of the oxygen concentration battery cell type, rather than being of the limit current type as in the shown preferred embodiments. Other possible variations could be conceived of. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. A method for controlling electrical power supplied to an electrically powered heater incorporated in an oxygen sensor element in an exhaust system of an internal combustion engine, said heater being adapted to heat oxygen sensing elements such as electrodes and exhaust gas dispersing layers of said oxygen sensor when said heater is supplied with electrical power, wherein the method comprises:

determining the temperature of said engine at the time of starting up the engine, and only if the temperature of said engine at the time of starting is less than a certain value, providing said heater with electrical power to the maximum practicable amount for a certain continuous time duration after said engine is started up.

2. A method for controlling heater electrical power according to claim 1, wherein said certain continuous time duration during which after engine starting up said heater is provided with electrical power to the maximum practicable amount is determined according to the engine starting temperature, and is longer, the lower is said engine starting temperature.

3. A method for controlling heater electrical power according to claim 1, wherein said maximum practical amount of heater power is the maximum power deliverable from the power source to said heater.

4. A method for controlling electrical power supplied to an electrically powered heater of an oxygen sensor element in an exhaust passage of an internal combustion engine, wherein the method comprises:

determining the temperature of said engine at the time of starting up the engine, and only if the temperature of said engine at the time of starting the engine is less than a certain value, providing said heater with electrical power to the maximum practicable amount for a certain time interval after said engine is started up, wherein said certain time interval, during which after engine starting up said heater is provided with electrical power to the maximum practicable amount, is determined according to power supply voltage, and is longer, the lower is said power supply voltage.

5. A system for controlling electrical power supplied to an electrically powered heater incorporated in an oxygen sensor in an exhaust system of an internal combustion engine, said heater being adapted to heat oxygen sensing elements such as electrodes and exhaust gas dispersing layers of said oxygen sensor when said heater is supplied with electrical power, wherein the system comprises:

a means for detecting the temperature of said engine at the time of starting up;

a means for determining whether or not said starting up engine temperature is less than a predetermined value; and a means for, if at said time of starting up the engine the temperature of said engine is less than said certain value, providing said heater with electrical power to the maximum practicable amount, for a certain continuous time duration after said engine is started up.

6. A system for controlling heater electrical power according to claim 5, further comprising a means for determining said certain continuous time duration during which after engine starting up said heater is to be provided with electrical power to the maximum practicable amount according to the engine starting temperature, and for making it be longer, the lower is said engine starting temperature.

7. A system for controlling heater electrical power according to claim 5, wherein said maximum practical amount of heater power is the maximum power deliverable from the power source to said heater.

8. A system for controlling electrical power supplied to an electrically powered heater of an oxygen sensor element in an exhaust passage of an internal combustion, wherein the system comprises:

a means for detecting the temperature of said engine at the time of starting up;

a means for determining whether or not said starting up engine temperature is less than a predetermined value; and a means for, only if at said time of starting up the engine the temperature of said engine is less than said certain value, providing said heater with electrical power to the maximum practicable amount, for a certain time interval after said engine is started up, the system further comprising a means for determining said certain time interval, during which after engine starting up said heater is to be provided with electrical power to the maximum practicable amount, according to the power supply voltage, and for making it be longer, the lower is said power supply voltage.

* * * * *

UNITED STATES PATENT AND TRADEMARK OFFICE

CERTIFICATE OF CORRECTION

PATENT NO. : 4,655,182

DATED : 7 April 1987

INVENTOR(S) : Jiro NAKANO et al.

It is certified that error appears in the above-identified patent and that said Letters Patent is hereby corrected as shown below:

| Column | Line | |
|---|---|---|
| 2 | 44: | change "furthr" to --further--. |
| 3 | 1: | change "provides" to --provide--. |
| 3 | 6: | change "maintains" to --maintain--. |
| 4 | 61: | before "time" delete "the". |
| 7 | 11: | change "instantaneouly" to --instantaneously--. |
| 12 | 56: | change "tmperature" to --temperature-- |
| 14 | 49: | after "combustion" insert --engine--. |

Signed and Sealed this

Twentieth Day of October, 1987

*Attest:*

*Attesting Officer*

DONALD J. QUIGG

*Commissioner of Patents and Trademarks*